US009750339B2

(12) United States Patent
Turner et al.

(10) Patent No.: US 9,750,339 B2
(45) Date of Patent: Sep. 5, 2017

(54) BLOW-MOLDED TABLE

(71) Applicant: Ameriwood Industries, Inc., Wright City, MO (US)

(72) Inventors: Dennis M Turner, Mooresville, IN (US); Andrew B Mendenhall, Mooresville, IN (US); Paul T Zink, Fishers, IN (US); Terrence C Bergin, Indianapolis, IN (US); Simon L Leclerc, Naperville, IL (US); Christopher N Brauer, Zionsville, IN (US)

(73) Assignee: Dorel Home Furnishings, Inc., Wright City, MO (US)

( * ) Notice: Subject to any disclaimer, the term of this patent is extended or adjusted under 35 U.S.C. 154(b) by 0 days.

(21) Appl. No.: 15/040,340

(22) Filed: Feb. 10, 2016

(65) Prior Publication Data

US 2016/0227919 A1 Aug. 11, 2016

Related U.S. Application Data

(60) Provisional application No. 62/114,810, filed on Feb. 11, 2015.

(51) Int. Cl.
*A47B 3/083* (2006.01)
*A47B 3/08* (2006.01)

(52) U.S. Cl.
CPC ..... *A47B 3/083* (2013.01); *A47B 3/0818* (2013.01); *A47B 2003/0821* (2013.01); *A47B 2003/0827* (2013.01)

(58) Field of Classification Search
CPC ..... A47B 3/00; A47B 3/091; A47B 3/0809; A47B 3/087; A47B 3/0818; A47B 3/002
USPC ..... 108/115, 132, 129, 131, 133, 162, 169, 108/170, 171, 172, 173, 174, 175; 248/188.6
See application file for complete search history.

(56) References Cited

U.S. PATENT DOCUMENTS

| | | | | |
|---|---|---|---|---|
| 2,709,631 | A * | 5/1955 | Covucci | A47B 3/087 108/167 |
| 2,903,313 | A | 9/1959 | Block | |
| 3,144,841 | A * | 8/1964 | Meringoff | A47B 3/087 108/173 |
| 4,383,488 | A * | 5/1983 | Macho | A47B 3/08 108/129 |
| 4,462,636 | A * | 7/1984 | Markson | A47C 16/02 108/128 |
| 5,421,272 | A * | 6/1995 | Wilmore | A47B 3/087 108/115 |
| 5,943,965 | A | 8/1999 | Riach et al. | |
| 6,334,400 | B1 | 1/2002 | Nien | |
| 6,752,091 | B2 | 6/2004 | Glover et al. | |
| 6,779,466 | B2 | 8/2004 | Shabram, Jr. | |
| 6,905,166 | B2 * | 6/2005 | Zhurong | A47B 3/0912 108/132 |
| 6,920,832 | B2 | 7/2005 | Lou-Hao | |

(Continued)

OTHER PUBLICATIONS

PCT Search Report and Written Opinion completed Mar. 31, 2016 and issued in connection with PCT/US2016/017268.

*Primary Examiner* — Jose V Chen
(74) *Attorney, Agent, or Firm* — Barnes & Thornburg LLP

(57) ABSTRACT

A folding table includes a table top and a table top elevator. A hinge unit is coupled between panels of the table top to allow the folding table to be folded.

21 Claims, 8 Drawing Sheets

(56) References Cited

U.S. PATENT DOCUMENTS

| | | | | |
|---|---|---|---|---|
| 7,278,361 | B2 | 10/2007 | Zhurong et al. | |
| 7,337,728 | B2 | 3/2008 | Shabram, Jr. et al. | |
| 7,461,601 | B2 | 12/2008 | Jin et al. | |
| 7,475,641 | B2 | 1/2009 | Jin | |
| 7,634,969 | B2 | 12/2009 | Neunzert et al. | |
| 7,640,870 | B2 | 1/2010 | Strong et al. | |
| 7,703,402 | B2 | 4/2010 | Larcom et al. | |
| 7,707,948 | B2 | 5/2010 | Lin | |
| 7,707,949 | B2 | 5/2010 | Larcom et al. | |
| 7,735,431 | B2 | 6/2010 | Neunzert et al. | |
| 7,752,982 | B2 * | 7/2010 | Lin | A47B 3/08 108/168 |
| 7,757,617 | B2 * | 7/2010 | Larcom | A47B 3/0815 108/132 |
| 7,814,844 | B2 * | 10/2010 | Haney | A47B 13/08 108/129 |
| 7,922,245 | B1 | 4/2011 | Sawhney | |
| 7,975,625 | B2 * | 7/2011 | Topham | A47B 3/0803 108/115 |
| 8,132,517 | B2 | 3/2012 | Leng | |
| 8,156,875 | B2 | 4/2012 | Neunzert et al. | |
| 8,371,646 | B1 | 2/2013 | Sawhney | |
| 8,388,055 | B1 | 3/2013 | Sawhney | |
| 8,397,653 | B2 | 3/2013 | Ashby et al. | |
| 8,408,640 | B1 | 4/2013 | Sawhney | |
| 8,573,139 | B2 | 11/2013 | Ashby et al. | |
| 8,661,991 | B2 * | 3/2014 | Eveleth | A47B 3/08 108/115 |
| 8,677,912 | B1 | 3/2014 | Tsai | |
| 8,726,817 | B2 | 5/2014 | Bennett et al. | |
| 8,881,661 | B2 | 11/2014 | Tsai | |
| 2002/0119844 | A1 | 8/2002 | Dadbeh | |
| 2005/0241551 | A1 | 11/2005 | Neunzert et al. | |
| 2014/0115827 | A1 | 5/2014 | Tsai | |
| 2014/0116301 | A1 | 5/2014 | Tsai | |
| 2014/0208992 | A1 | 7/2014 | Cai et al. | |
| 2014/0345505 | A1 | 11/2014 | Bennett et al. | |
| 2014/0345506 | A1 | 11/2014 | Clegg et al. | |
| 2015/0144036 | A1 | 5/2015 | Peery et al. | |

* cited by examiner

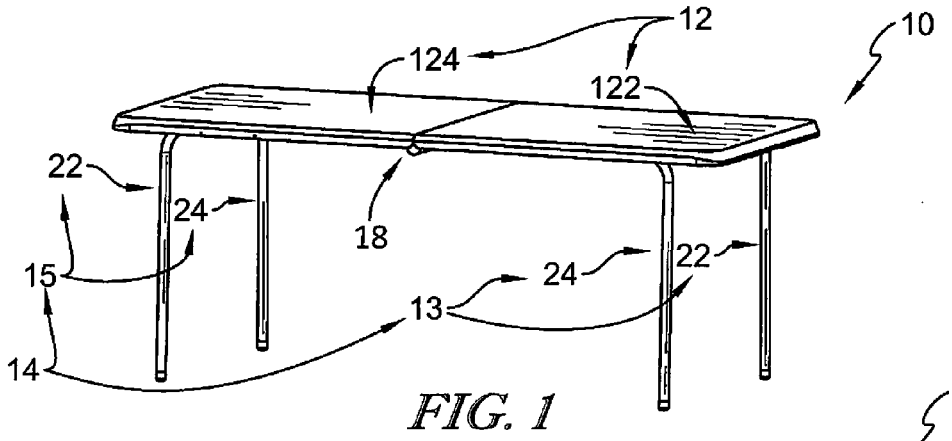
FIG. 1
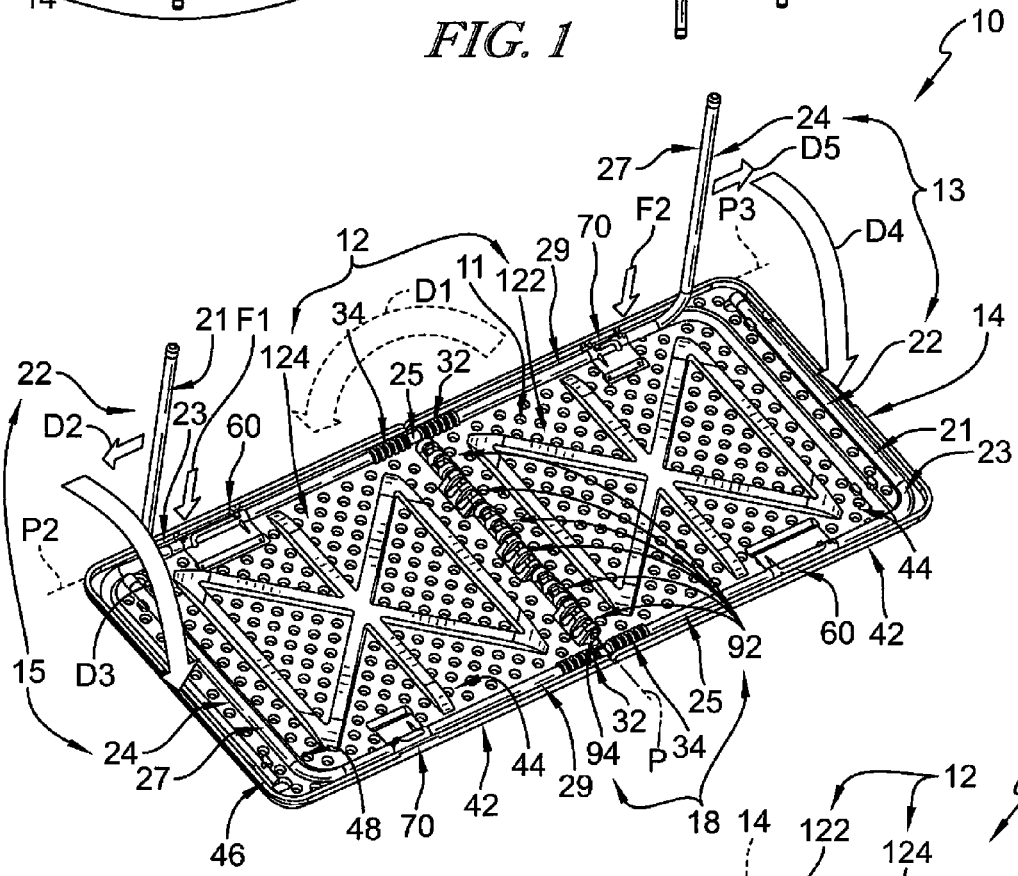
FIG. 2
FIG. 3

BLOW-MOLDED TABLE

CROSS REFERENCE TO RELATED APPLICATIONS

This application claims priority under 35 U.S.C. §119(e) to U.S. Provisional Patent Application No. 62/114,810, filed Feb. 11, 2015, which is expressly incorporated by reference herein.

BACKGROUND

The present disclosure relates to a table, and particularly to a folding table. More particularly, the present disclosure relates to a folding table having a blow-molded table top.

SUMMARY

A folding table in accordance with the present disclosure includes a table top and a table top elevator coupled to the table top to support the table top in spaced-apart relation above ground supporting the folding table. The table top includes a first panel, a second panel, and a hinge unit arranged to extend between and interconnect the first and second panels. The hinge unit allows rotation of the first panel relative to the second panel between an expanded-use position and a collapsed-storage position.

In illustrative embodiments, the table top elevator includes a first leg unit coupled to the first panel of the table top and a second leg unit coupled to the second panel. The first and second leg units each include a support leg and a table-locker leg. The support legs are each movable from a stowed position arranged to extend along the table top to a support position arranged to extend away from the table top. The table-locker legs are movable from an unlocked position arranged to extend along the table top and under one of the first panel and second panel to a locked position arranged to extend away from the table top and under both the first panel and the second panel to engage the support leg and block rotation of the first and second panel relative to one another. As such, the table-locker legs provide lock means for holding the table top in the expanded-use position when the table-locker legs are in the locked position so that the table top is held in place during use of the folding table.

In illustrative embodiments, the folding table further includes leg-slider guides positioned to block the table-locker legs from pivoting relative to the table top when in the locked position and allow pivoting when in the unlocked position. The leg-slider guides may each include a guide track formed through a cover plate coupled the table top and a wedge coupled to the table-locker leg and positioned to travel within the guide track.

In illustrative embodiments, the folding table further includes leg-slider guides positioned to block the support legs from pivoting relative to the table top when in the support position and allow pivoting when in the stowed position. The leg-slider guides may each include a guide track formed through a cover plate coupled the table top and a wedge coupled to the support leg and positioned to travel within the guide track.

In illustrative embodiments, an end connector of the table-locker leg of one leg unit is configured to be received in an end receiver of the support leg of the other leg unit.

In illustrative embodiments, the hinge unit includes a first hinge-pin receiver coupled to the first panel, a second hinge-pin receiver coupled to the second panel, and a hinge pin positioned through the first and second hinge-pin receivers to couple the first panel to the second panel and allow rotation of the first panel relative to the second panel.

In illustrative embodiments, the hinge unit includes a first plurality of fingers coupled to the first panel, a second plurality of fingers coupled to the second panel, and a hinge pin positioned through the first plurality and second plurality of fingers to couple the first panel to the second panel and allow rotation of the first panel relative to the second panel.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 1 is a top perspective view of a folding table in accordance with the present disclosure showing that the folding table includes a table top, a hinge unit coupled between left-side and right-side panels of the table top, and a table top elevator positioned to support the table top in an expanded-use position;

FIG. 2 is a bottom perspective view of the folding table of FIG. 1 showing that the table top elevator includes table-locker legs adapted to slide and pivot from a locked position extending under both panels of the table top across a joint between the two panels of the table top and engaged with opposing support legs of the table top elevator to hold the table top in the expanded-use position and an unlocked position extending under one panel of the table top and disengaged from the support legs to allow the table top panels to pivot relative to one another about a pivot axis toward a collapsed-storage position as suggested in FIG. 3;

FIG. 3 is a top perspective view of the folding table of FIG. 1 showing the folding table in the collapsed-storage position and suggesting that the table top elevator is stored between the panels of the table top when the folding table is in the collapsed-storage position;

DETAILED DESCRIPTION

Figure 4:
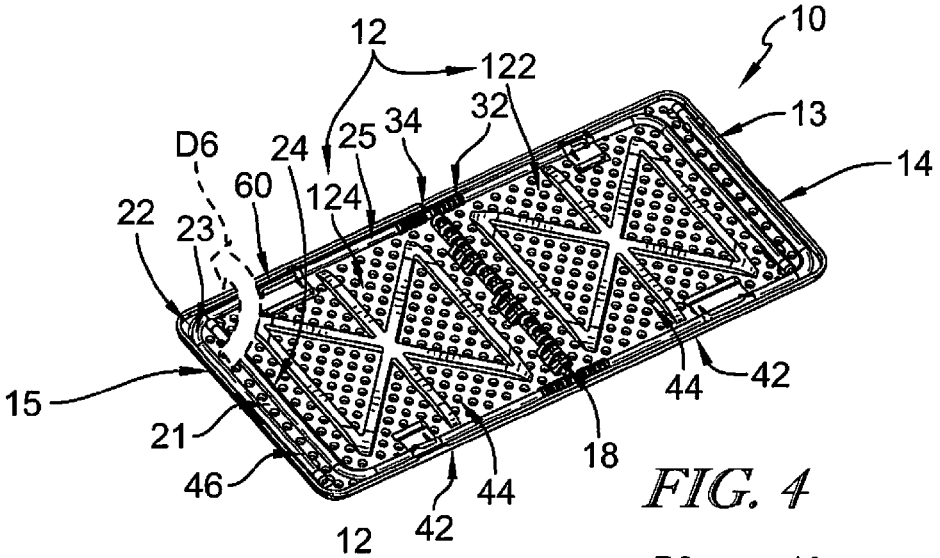
FIG. 4 is bottom perspective view of the folding table of FIG. 1 showing the table top in an unfolded position with the table-locker leg in the unlocked position extending along one of the panels of the table top and suggesting that a pivot section of the table-locker leg is coupled along an edge of the table top to allow the table-locker leg to pivot from the unlocked position to an extended position as shown in FIG. 5.

A folding table 10 in accordance with the present disclosure includes a table top 12 and a table top elevator 14 coupled to table top 12 for supporting table top 12 above a ground level as shown in FIG. 1. Table top 12 includes a right-side panel 122 and a left-side panel 124 coupled to right-side panel 122 by a hinge unit 18 (sometimes called a piano hinge 18) for rotation about a pivot axis P between an expanded-use position, shown in FIG. 1, and a collapsed-storage position, shown in FIG. 3, where right-side panel 122 and left-side panel 124 are folded toward one another about the pivot axis P. In some examples, right-side panel 122 and left-side panel 124 are formed by blow-molding a plastic material into the panels 122, 124. In the illustrative example, weld cones 11 are formed into an underside 44 and optionally engaged with a top side 42 of each panel 122, 124 during the blow-molding process.

Table top elevator 14 includes a right-side leg unit 13 coupled to right-side panel 122 of table top 12 and a left-side leg unit 15 coupled to left-side panel 124 as suggested in FIGS. 1 and 2. Right-side panel 122 and a left-side panel 124 of table top 12 each include a top side 42 positioned to support items placed on folding table 10 and an under side 44 as shown in FIG. 2. Right-side leg unit 13 is coupled to under side 44 of right-side panel 122 and left-side leg unit 15 is coupled to under side 44 of left-side panel 124. Right-side leg unit 13 and left-side leg unit 15 each include a table-locker leg 22 (sometimes called active leg 22) and a support leg 24 (sometimes called passive leg 24). Table-locker legs 22 are positioned at opposing corners of table top 12. Similarly, support legs 24 are positioned at opposing corners of table top 12.

Figure 7:
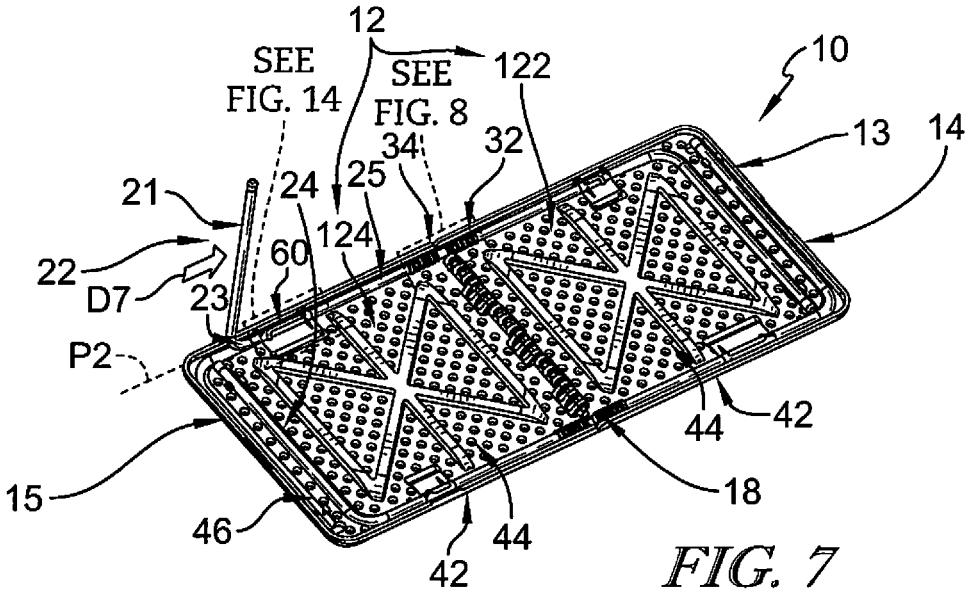
FIG. 7 is a view similar to FIG. 5 showing the table-locker leg in the locked position after sliding relative to the table top.

Each table-locker leg 22 is pivotable and slidable relative to table top 12 as suggested in FIG. 2. Table-locker legs 22 are configured to move between an unlocked position, as shown in FIG. 4, and a locked position, as shown in FIG. 7. Table-locker legs 22 are configured to block movement of the panels 122, 124 from the expanded-use position to the collapsed-storage position when in the locked position. Table-locker legs 22 are configured to allow movement of the panels 122, 124 of the table top 12 between the collapsed-storage position and the expanded use position when in the unlocked position. Accordingly, table-locker legs 22 provide means for holding the table top 12 in the expanded-use position so that the table top is maintained in the expanded-use position during use of the folding table 10.

Each table-locker leg 22 includes a leg section 21, a pivot section 23 coupled to leg section 21, and a lock section 25 coupled to pivot section 23 as suggested in FIG. 2. Leg section 21 is configured to support table top 12. Pivot section 23 is coupled along an edge of table top 12 and configured to allow rotation of table-locker leg 22 about a locker-leg pivot axis P2 during movement between the unlocked position and the locked position as suggested in FIG. 5. In one example, locker-leg axis P2 is generally perpendicular to pivot axis P.

Figure 8:
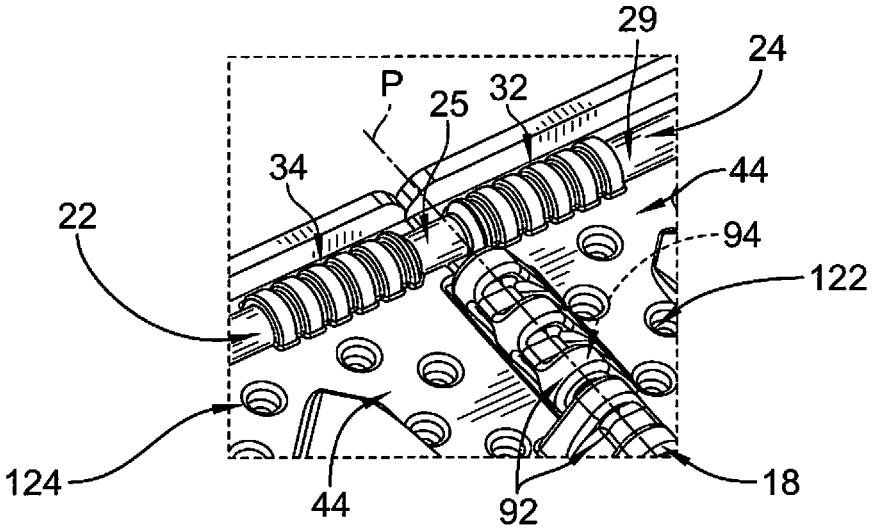
FIG. 8 is an enlarged view of FIG. 7 showing the lock section of the table-locker leg positioned across the pivot axis of the table top when the table-locker leg is in the locked position to block the panels of the table top from pivoting relative to one another.

Lock section 25 extends along the edge of table top 12 and is received in blocker brackets 32, 34 when table-locker leg 22 is in the locked position as suggested in FIG. 8. In the illustrative example, blocker brackets 32, 34 are formed integrally with panels 122, 124 and receive table-locker legs 22 to block movement of table top 12 from the expanded-use position to the collapsed-storage position. In some examples, blocker brackets 32, 34 are separate components coupled to undersides 44 of panels 122, 124.

Figure 6:
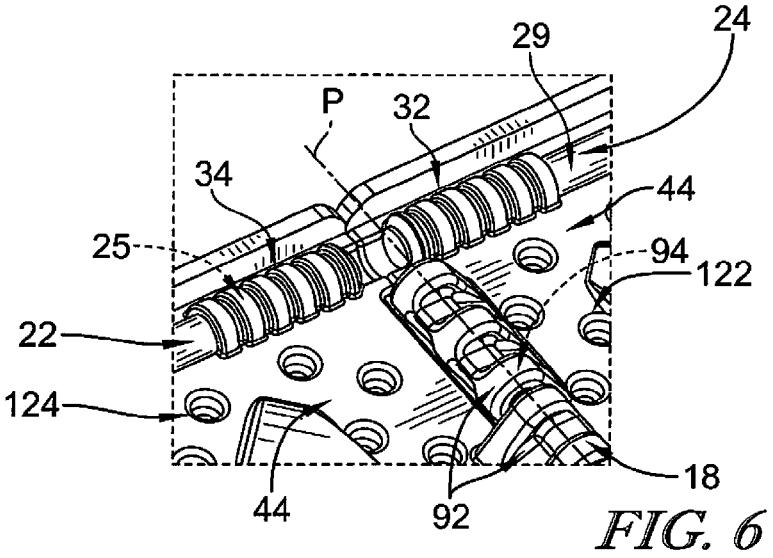
FIG. 6 is an enlarged view of FIG. 5 showing a lock section of the table-locker leg positioned to one side of a pivot axis of the table top when the table-locker leg is in the unlocked position to allow the panels of the table top to pivot relative to one another.

In the unlocked position, lock section 25 of table-locker leg 22 is positioned under one of panels 122, 124 of table top 12 and to one side of pivot axis P as suggested in FIG. 6. In the locked position, lock section 25 of table-locker leg 22 is positioned under both of panels 122, 124 of table top 12 and across pivot axis P as suggested in FIG. 8. In the illustrative example, an end connector 56 of table-locker leg 22 is received in an end receiver 58 of support leg 24 when table-locker leg 22 is in the locked position as suggested in FIGS. 11 and 13. In some examples, lock section 25 is swedged to form end connector 56. In some examples, end connector 56 and end receiver 58 are positioned to lie substantially within blocker bracket 32 when table-locker leg 22 is in the locked position.

Figure 14:
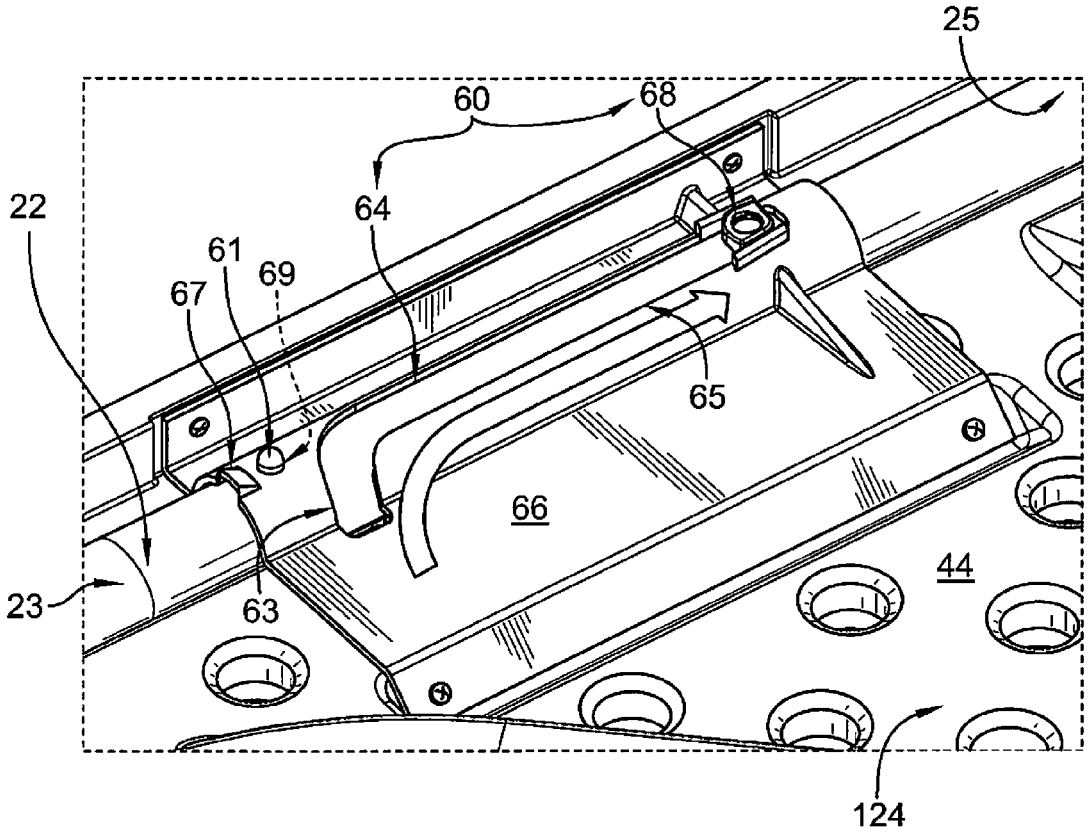
FIG. 14 is an enlarged view of FIG. 7 showing that a leg-slider guide adapted to control motion of the table-locker legs includes a guide track formed through a cover plate attached to the table top and a wedge coupled to the pivot section of the table-locker leg of the table top elevator which moves in the guide track to allow the table-locker leg to pivot relative to the table top when the wedge travels in a pivot portion of the guide track and slide relative to the table top while block pivoting movement when the wedge travels in a slide portion of the guide track.

A leg-slider guide 60 is positioned to guide movement of table-locker legs 22 relative to table top 12 as suggested in FIGS. 2 and 14. Leg-slider guide 60 includes a guide track 64 formed through a cover plate 66 (sometimes called bracket 66) coupled to under sides 44 and a wedge 68 coupled to table-locker leg 22 as shown in FIG. 14. In the illustrative example, wedge 68 is diamond shaped with two rounded corners and is configured to travel within guide track 64 to control motion of table-locker leg 22. Guide track 64 includes a pivot portion 63 and a slide portion 65. Pivot portion 63 is configured to allow table-locker legs 22 to pivot relative to table top 12 and block sliding movement while wedge 68 is traveling within pivot portion 63. Slide portion 65 is configured to allow table-locker legs 22 to slide relative to table top 12 and block pivoting movement while wedge 68 is traveling within slide portion 65.

Table-locker leg 22 also includes a position-locator pin 61 for holding table-locker leg 22 in the locked position at the selection of a user as suggested in FIG. 14. In some examples, position-locator pin 61 is a VALCO pin. Position-locator pin 61 engages a pin hole 69 formed through a cover plate 66 coupled to under side 44 to block sliding movement of table-locker leg 22. A pin ramp 67 coupled to cover plate 66 depresses position-locator pin 61 as table-locker leg 22 slides from the unlocked position to the locked position to allow position-locator pin 61 to travel beneath cover plate 66 to pin hole 69. A user disengages position-locator pin 61 from engagement with pin hole 69 by depressing position-locator pin 61 to allow table-locker leg 22 to slide from the locked position to the unlocked position.

Figure 9:
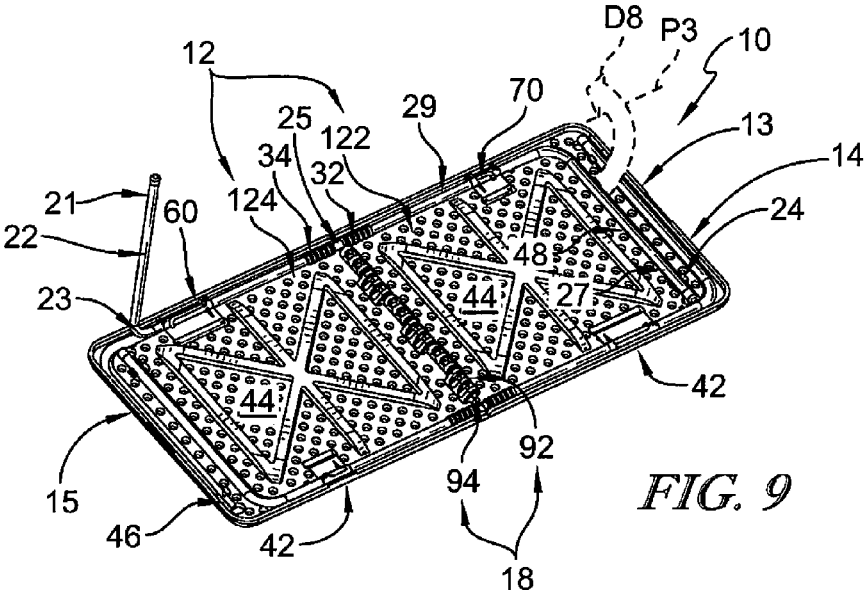
FIG. 9 is a view similar to FIG. 7 showing a support leg of the table top elevator in a stowed position extending along one of the panels of the table top and suggesting that a pivot section of the support leg is coupled along an edge of the table top to allow the support leg to pivot from the stowed position to an extended position as shown in FIG. 10.
Figure 12:
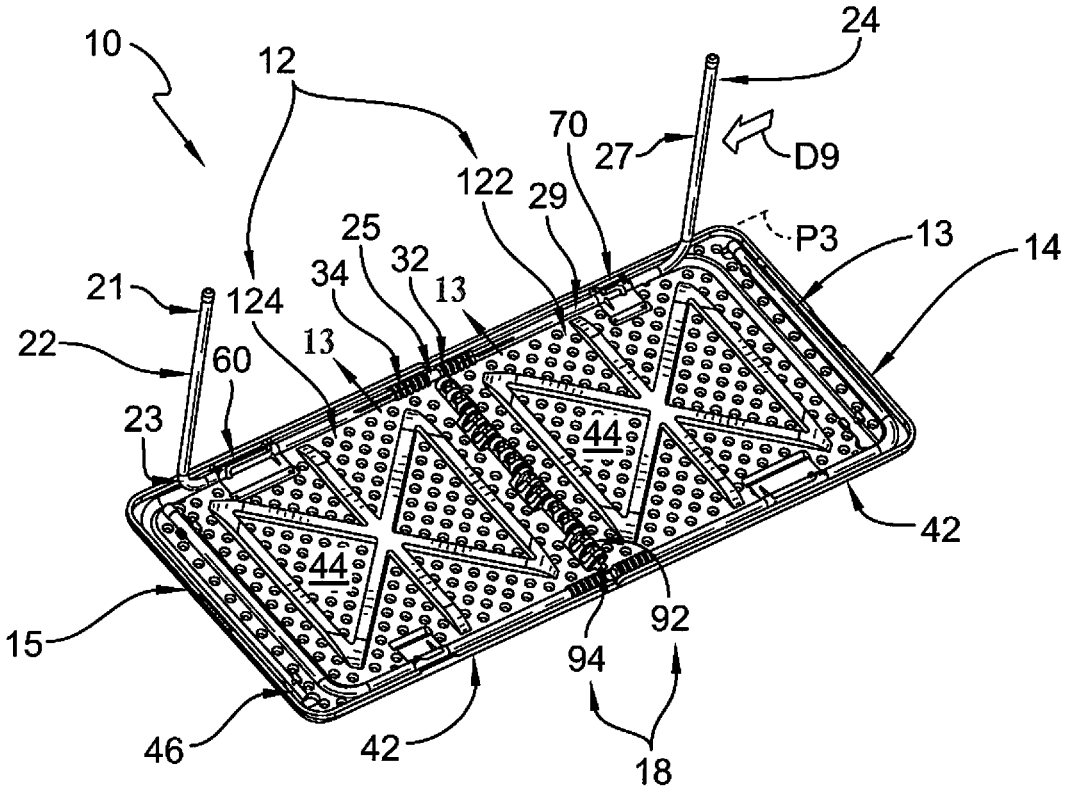
FIG. 12 is a view similar to FIG. 10 showing the support leg in the support position after sliding relative to the table top.

Each support leg 24 is pivotable and slidable relative to table top 12 between a support position, associated with the expanded-use position, and a stowed position associated with the collapsed-storage position as suggested in FIGS. 9 and 12. Each support leg includes a leg section 27 and a pivot section 29 coupled to leg section 27. Leg section 27 is configured to support table top 12. Pivot section 29 is coupled along an edge of table top 12 and configured to allow rotation of support leg 24 relative to table top 12 about a support-leg pivot axis P3 during movement between the stowed position and the support position. In on example, support-leg pivot axis P3 is generally perpendicular to the pivot axis P and generally parallel to locker-leg axis P2. In another example, support-leg pivot axis P3 is generally collinear with locker-leg axis P2 as suggested in FIG. 5.

A leg-slider guide 70, similar to leg-slider guide 60, controls movement of support leg 24 at the selection of a user. In the illustrative example, a slide portion of leg-slider guide 70 is shorter than slide portion 65 of leg-slider guide 60. In some examples, support leg 24 also includes a position-locator pin for holding support leg 24 in the support position at the selection of a user.

In the illustrative example, table-locker leg 22 and support leg 24 are L-shaped as shown in FIG. 2. As such, leg sections 21, 27 provide vertical support to table top 12 and pivot sections 23, 29 and lock sections 25 provide horizontal support to table top 12. With end connectors 56 of table-locker legs 22 received in end receivers 58 of support legs 24, leg units 13, 15 provide substantially continuous horizontal support along a length of folding table 10. In some examples, table-locker legs 22 and support legs 24 are formed from bent metal tubing.

Each under side 44 of right-side and left-side panels 122, 124 is formed to include a locker-leg receiver 46 positioned to receive leg section 21 of table-locker leg 22 and a support-leg receiver 48 positioned to receive leg section 27 of support leg 24 as suggested in FIG. 2. Table-locker leg 22 slides relative to table top 12 from the locked position to the unlocked position and leg section 21 pivots relative to table top 12 to be received in locker-leg receiver 46. Support leg 24 slides relative to table top 12 from the support position to the stowed position and leg section leg section 27 pivots relative to table top 12 to be received in support-leg receiver 48.

Hinge unit 18 includes hinge-pin receivers 92 coupled to under sides 44 of right-side and left-side panels 122, 124 and a hinge pin 94 positioned through hinge-pin receivers 92 as suggested in FIG. 2. Hinge-pin receivers 92 of panels 122, 124 are aligned along pivot axis P to allow panels 122, 124 to pivot relative to one another about hinge pin 94. In some examples, hinge pin 94 is a solid pin. In some examples, hinge pin 94 is a tube. In the illustrative example, each of right-side panel 122 and left-side panel 124 includes three hinge-pin receivers 92. Hinge-pin receivers 92 of right-side panel 122 are interlaced with hinge-pin receivers of left-side panel 124. While three hinge-pin receivers are shown for each of panels 122, 124, more or less hinge-pin receivers 92 may be used, and panels 122, 124 may include differing numbers of hinge-pin receivers 92. In some examples, hinge-pin receivers 92 are integrally formed with panels 122, 124.

In the collapsed-storage position, right-side and left-side panels 122, 124 are rotated about pivot axis P such that under sides 44 are in confronting relation as suggested in FIG. 3. Table-locker legs 22 are in the unlocked position and leg sections 21 are positioned in locker-leg receivers 46. Similarly, support legs 24 are in the stowed position and leg sections 27 are positioned in support-leg receivers 48. Table top elevator 14 is trapped between panels 122, 124 when table top 12 is in the collapsed-storage position as suggested in FIG. 3. In the expanded-use position, right-side and left-side panels 122, 124 are rotated about pivot axis P such that right-side and left-side panels 122, 124 are positioned in substantially the same plane as suggested in FIG. 1. Table-locker legs 22 are in the locked position and lock sections 25 extend across pivot axis P to block rotation of panels 122, 124. Similarly, support legs 24 are in the support position.

Figure 5:
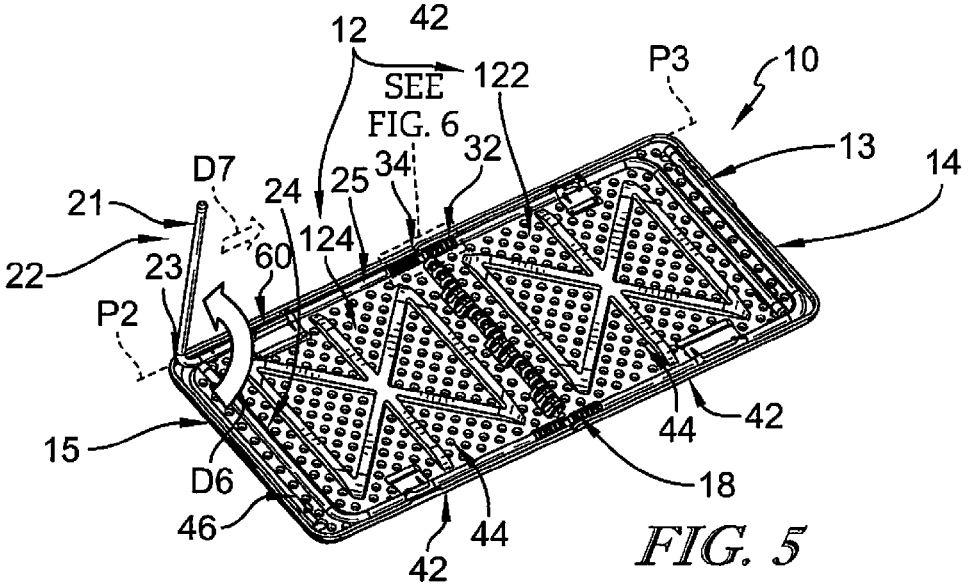
FIG. 5 is a view similar to FIG. 4 showing the table-locker leg in the extended position after pivoting relative to the table top and suggesting that moving the table-locker leg to the extended position allows the table-locker leg to slide relative to the table top to a locked position as shown in FIG. 7.
Figure 10:
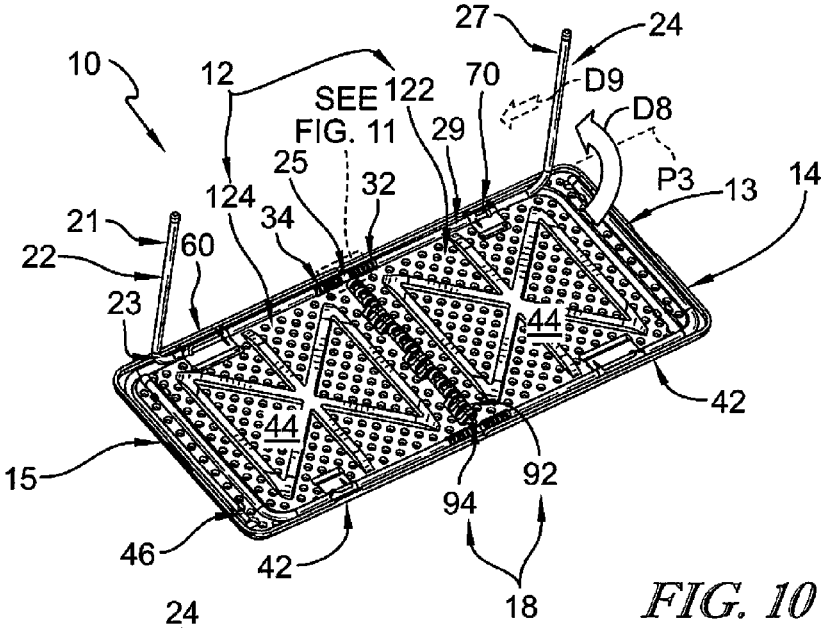
FIG. 10 is a view similar to FIG. 9 showing the support leg in the extended position after pivoting relative to the table top and suggesting that moving the support leg to the extended position allows the support leg to slide relative to the table top to a support position as shown in FIG. 12.
Figure 11:
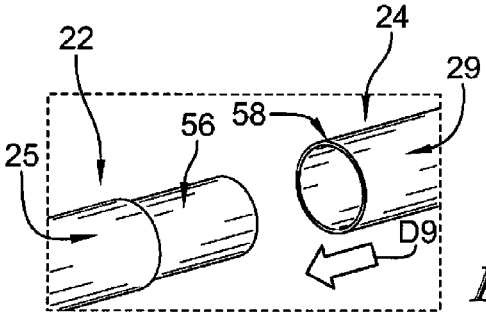
FIG. 11 is an enlarged view of FIG. 10 showing an end connector of the table-locker leg spaced apart from an end receiver of the support leg and suggesting that the end receiver moves toward the end connector as the support leg moves from the extended position to the support position such that the end connector is received in the end receiver when the support leg is in the support position as shown in FIG. 13.
Figure 13:
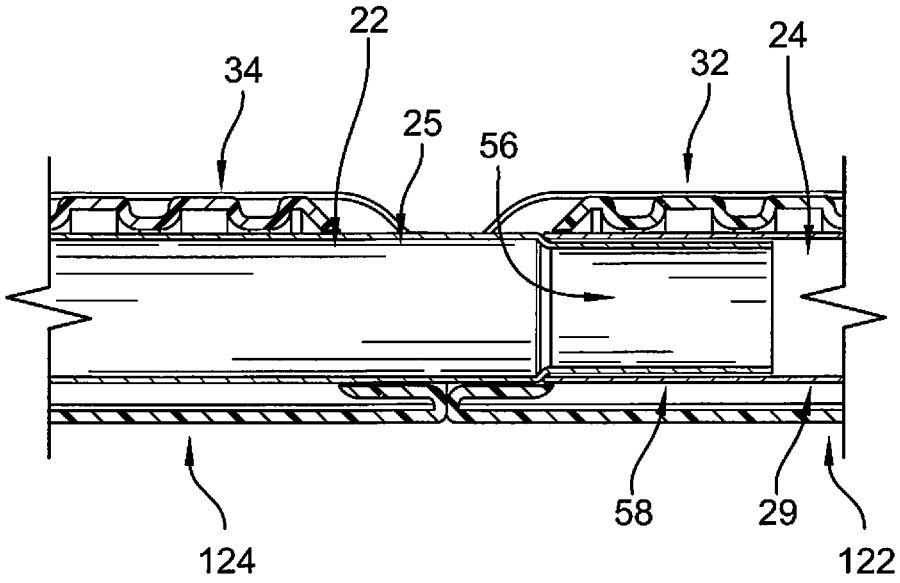
FIG. 13 is a sectional view taken along line 13-13 in FIG. 12 showing the end connector of the table-locker leg received in the end receiver of the support leg to allow the leg units to provide horizontal support along a length of the table top.

After unfolding table top 12, a user pivots leg section 21 of table-locker leg 22 relative to table top 12 as shown in FIGS. 4 and 5. A user slides table-locker leg 22 relative to table top 12 such that lock section 25 extends across pivot axis P as shown in FIGS. 7 and 8. A user pivots leg section 27 of support leg 24 relative to table top 12 as shown in FIGS. 9 and 10. A user slides support leg 24 relative to table top 12 such that end connector 56 is received in end receiver 58 as shown in FIGS. 11 and 13. The table-locker legs 22 and support legs 24 of both leg units 13, 15 are moved in this way. A user does the reverse to allow table top 12 to move to the collapsed-storage position.

Figure 15:
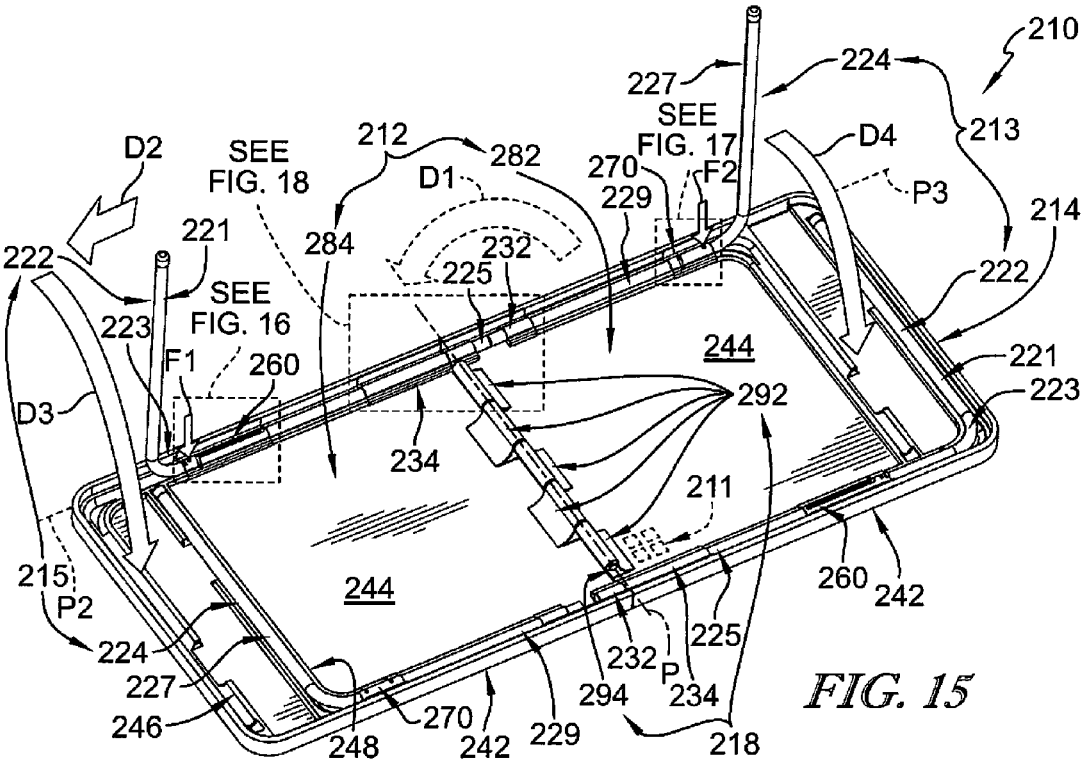
FIG. 15 is a bottom perspective view of another embodiment of a folding table in accordance with the present disclosure showing that the folding table includes a table top, a hinge unit coupled between left-side and right-side panels of the table top, and a table top elevator positioned to support the table top in an expanded-use position and suggesting that the table top elevator includes table-locker legs adapted to slide and pivot from a locked position extending under both panels of the table top across a joint between the two panels of the table top and engaged with opposing support legs of the table top elevator to hold the table top in the expanded-use position, as shown in FIG. 18, and an unlocked position extending under one panel of the table top and disengaged from the support legs to allow the table top panels to pivot relative to one another about a pivot axis toward a collapsed-storage position.

Another example of a folding table 210 in accordance with the present disclosure is shown in FIG. 15. Folding table 210 includes a table top 212 and a table top elevator 214 coupled to table top 212 for supporting table top 212 above a ground level. Table top 212 includes a right-side panel 282 and a left-side panel 284 coupled to right-side panel 282 by a hinge unit 218 (sometimes called a piano hinge 218) for rotation about a pivot axis P between an expanded-use position and a collapsed-storage position where right-side panel 282 and left-side panel 284 are folded toward one another about the pivot axis P. In some examples, right-side panel 282 and left-side panel 284 are formed by blow-molding a plastic material into the panels 282, 284. In some examples, weld cones 211, illustratively shown as squares in phantom in FIG. 15, are formed into an underside 244 and optionally engaged with a top side 242 of each panel 282, 284 during the blow-molding process.

Table top elevator 214 includes a right-side leg unit 213 coupled to right-side panel 282 of table top 212 and a left-side leg unit 215 coupled to left-side panel 284 as suggested in FIG. 15. Right-side panel 282 and a left-side panel 284 of table top 212 each include a top side 242 positioned to support items placed on folding table 210 and an under side 244. Right-side leg unit 213 is coupled to under side 244 of right-side panel 282 and left-side leg unit 215 is coupled to under side 244 of left-side panel 284. Right-side leg unit 213 and left-side leg unit 215 each include a table-locker leg 222 (sometimes called active leg 222) and a support leg 224 (sometimes called passive leg 224). Table-locker legs 222 are positioned at opposing corners of table top 212. Similarly, support legs 224 are positioned at opposing corners of table top 212.

Each table-locker leg 222 is pivotable and slidable relative to table top 212 as suggested in FIG. 15. Table-locker legs 222 are configured to move between a locked position, as shown in FIG. 15, and an unlocked position. Table-locker legs 222 are configured to block movement of the panels 282, 284 from the expanded-use position to the collapsed-storage position when in the locked position. Table-locker legs 222 are configured to allow movement of the panels 282, 284 of the table top 212 between the collapsed-storage position and the expanded use position when in the unlocked position. Accordingly, table-locker legs 222 provide means for holding the table top 212 in the expanded-use position so that the table top is maintained in the expanded-use position during use of the folding table 210.

Each table-locker leg 222 includes a leg section 221, a pivot section 223 coupled to leg section 221, and a lock section 225 coupled to pivot section 223 as suggested in FIG. 15. Leg section 221 is configured to support table top 212. Pivot section 223 is coupled along an edge of table top 212 and configured to allow rotation of table-locker leg 222. Lock section 225 extends along the edge of table top 212 and is received in blocker brackets 232, 234 when table-locker leg 222 is in the locked position. Blocker brackets 232, 234 are coupled to undersides 244 of panels 282, 284 and receive table-locker legs 222 to block movement of table top 212 from the expanded-use position to the collapsed-storage position. In some examples, blocker brackets 232, 234 are integral with panels 282, 284.

Figure 18:
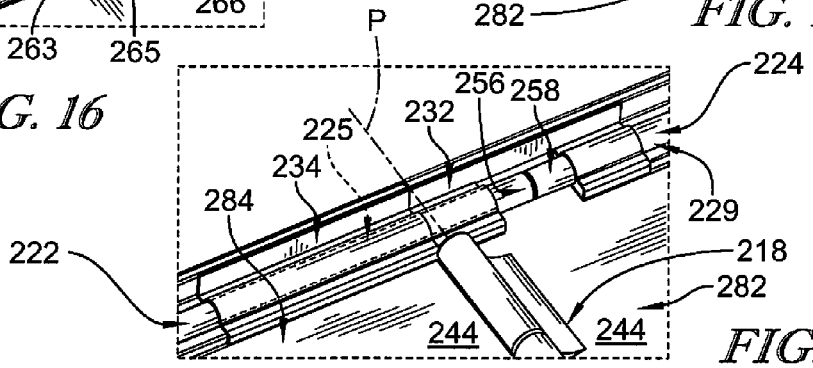
FIG. 18 is an enlarged view of FIG. 15 showing a lock section of the table-locker leg extending across a joint between the two panels of the table top and engaged with the opposing support leg of the table top elevator to hold the table top in the expanded-use position.

In the unlocked position, lock section 225 of table-locker leg 222 is positioned under one of panels 282, 284 of table top 212 and to one side of pivot axis P. In the locked position, lock section 225 of table-locker leg 222 is positioned under both of panels 282, 284 of table top 212 and across pivot axis P as suggested in FIG. 18. In the illustrative example, lock section 225 is received between blocker brackets 232, 234 and table top 212 when table-locker leg 222 is in the locked position. An end connector 256 of table-locker leg 222 is received in an end receiver 258 of support leg 224 when table-locker leg 222 is in the locked position. In some examples, lock section 25 is swedged to form end connector 56.

Figure 16:
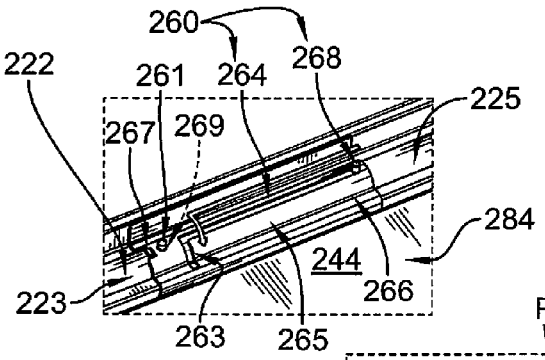
FIG. 16 is an enlarged view of FIG. 15 showing that a leg-slider guide adapted to control motion of the table-locker legs includes a guide track formed through a cover plate attached to the table top and a slide pin coupled to the table-locker leg which moves in the guide track to allow the table-locker leg to pivot relative to the table top when the slide pin travels in a pivot portion of the guide track and slide relative to the table top while block pivoting movement when the slide pin travels in a slide portion of the guide track.

A leg-slider guide 260 is positioned to guide movement of table-locker legs 222 relative to table top 212 as suggested in FIGS. 15 and 16. Leg-slider guide 260 includes a guide track 264 formed through a cover plate 266 (sometimes called bracket 266) coupled to under sides 244 and a slide pin 268 coupled to table-locker leg 222 as shown in FIG. 16. Slide pin 268 is configured to travel within guide track 264 to control motion of table-locker leg 222. Guide track 264 includes a pivot portion 263 and a slide portion 265. Pivot portion 263 is configured to allow table-locker legs 222 to pivot relative to table top 212 and block sliding movement while slide pin 268 is traveling within pivot portion 263. Slide portion 265 is configured to allow table-locker legs 222 to slide relative to table top 212 and block pivoting movement while slide pin 268 is traveling within slide portion 265.

Table-locker leg 222 also includes a position-locator pin 261 for holding table-locker leg 222 in the locked position at the selection of a user as suggested in FIG. 16. In some examples, position-locator pin 261 is a VALCO pin. Position-locator pin 261 engages a pin hole 269 formed through a cover plate 266 coupled to under side 244 to block sliding movement of table-locker leg 222. A pin ramp 267 coupled to cover plate 266 depresses position-locator pin 261 as table-locker leg 222 slides from the unlocked position to the locked position to allow position-locator pin 261 to travel beneath cover plate 66 to pin hole 269. A user disengages position-locator pin 261 from engagement with pin hole 269 by depressing position-locator pin 261 to allow table-locker leg 222 to slide from the locked position to the unlocked position.

Each support leg 224 is pivotable relative to table top 212 between a support position, associated with the expanded-use position, and a stowed position associated with the collapsed-storage position as suggested in FIG. 15. Each support leg includes a leg section 227 and a pivot section 229 coupled to leg section 227. Leg section 227 is configured to support table top 212. Pivot section 229 is coupled along an edge of table top 212 and configured to allow rotation of support leg 224 relative to table top 212. A pivot guide 270 blocks sliding movement of support leg 224 relative to table top 212 while allowing support leg 224 to pivot relative to table top 212 at the selection of a user.

Figure 17:
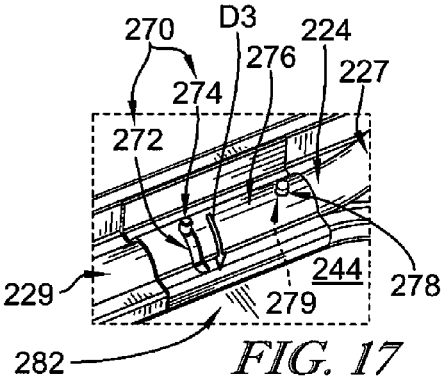
FIG. 17 is an enlarged view of FIG. 15 showing that a pivot guide adapted to control motion of the support leg includes a guide pin coupled to the support leg which moves in a guide slot to allow pivoting movement of the support leg relative to the table top while blocking sliding movement of the support leg.

Pivot guide 270 includes a guide slot 272 and a guide pin 274 (sometimes called tracking pin 274) configured to travel in guide slot 272 as suggested in FIG. 17. Guide slot 272 is formed through a guide plate 276 (sometimes called bracket 276) coupled to under side 244. Guide pin 274 is coupled to pivot section 229 of support leg 224 and travels within guide slot 272 to control movement of support leg 224. Each support leg 224 also includes a lock pin 278 coupled to pivot section 229 and positioned to engage a pin hole 279 formed through guide plate 276 to block rotation of support leg 224 from the support position to the stowed position at the selection of a user. In some examples, lock pin 278 is a VALCO pin. A user disengages lock pin 278 from pin hole 279 by depressing lock pin 278 to allow support leg 224 to rotate from the support position to the stowed position.

In the illustrative example, table-locker leg 222 and support leg 224 are L-shaped as shown in FIG. 15. As such, leg sections 221, 227 provide vertical support to table top 212 and pivot sections 223, 229 and lock sections 225 provide horizontal support to table top 212. With end connectors 256 of table-locker legs 222 received in end receivers 258 of support legs 224, leg units 213, 215 provide substantially continuous horizontal support along a length of folding table 210. In some examples, table-locker legs 222 and support legs 224 are formed from bent metal tubing.

Each under side 244 of right-side and left-side panels 282, 284 is formed to include a locker-leg receiver 246 positioned to receive leg section 221 of table-locker leg 222 and a support-leg receiver 248 positioned to receive leg section 227 of support leg 224 as suggested in FIG. 15. Table-locker leg 222 slides relative to table top 212 from the locked position to the unlocked position and leg section 221 pivots relative to table top 212 to be received in locker-leg receiver 246. Support leg 224 pivots from the support position to the stowed position such that leg section 227 is received in support-leg receiver 248.

Hinge unit 218 includes hinge-pin receivers 292 coupled to under sides 244 of right-side and left-side panels 282, 284 and a hinge pin 294 positioned through hinge-pin receivers 292 as suggested in FIG. 15. Hinge-pin receivers 292 of panels 282, 284 are aligned along pivot axis P to allow panels 282, 284 to pivot relative to one another about hinge pin 294. In some examples, hinge pin 294 is a solid pin. In some examples, hinge pin 294 is a tube. In the illustrative example, right-side panel 282 includes three hinge-pin receivers 292 and left-side panel 284 includes two hinge-pin receivers 292 positioned between the hinge-pin receivers 292 of right-side panel 282. Hinge-pin receivers 292 of right-side panel 282 are interlaced with hinge-pin receivers of left-side panel 284. More or less hinge-pin receivers 292 may be used, and panels 282, 284 may include the same number of hinge-pin receivers 292. In some examples, hinge-pin receivers 292 are integrally formed with panels 282, 284.

In the collapsed-storage position, right-side and left-side panels 282, 284 are rotated about pivot axis P such that under sides 244 are in confronting relation. Table-locker legs 222 are in the unlocked position and leg sections 221 are positioned in locker-leg receivers 246. Similarly, support legs 224 are in the stowed position and leg sections 227 are positioned in support-leg receivers 248. Table top elevator 214 is trapped between panels 282, 284 when table top 212 is in the collapsed-storage position. In the expanded-use position, right-side and left-side panels 282, 284 are rotated about pivot axis P such that right-side and left-side panels 282, 284 are positioned in substantially the same plane. Table-locker legs 222 are in the locked position and lock sections 225 extend across pivot axis P to block rotation of panels 282, 284. Similarly, support legs 224 are in the support position.

After unfolding table top 212, a user pivots leg section 221 of table-locker leg 222 relative to table top 212. A user slides table-locker leg 222 relative to table top 212 such that lock section 225 extends across pivot axis P and end connector 256 is received in end receiver 258. A user pivots leg section 227 of support leg 224 relative to table top 212. The table-locker legs 222 and support legs 224 of both leg units 213, 215 are moved in this way. A user does the reverse to allow table top 212 to move to the collapsed-storage position.

Figure 19:
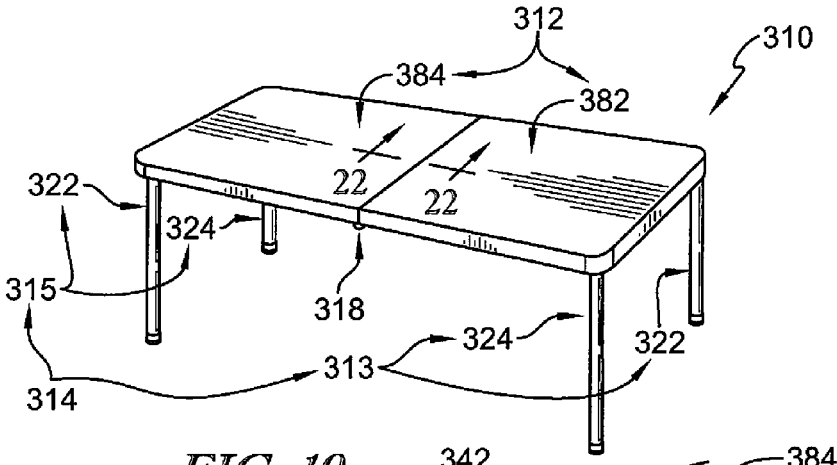
FIG. 19 is a top perspective view of another embodiment of a folding table in accordance with the present disclosure showing that the folding table includes a table top, a hinge unit coupled between left-side and right-side panels of the table top, and a table top elevator positioned to support the table top in an expanded-use position.

Another example of a folding table 310 in accordance with the present disclosure is shown in FIG. 19. Folding table 310 is similar to folding table 210 of FIGS. 15-18 with one difference being the form of hinge unit 318. As such, similar numbering in the 300 series are used to describe common features unless specifically contradicted below.

Figure 20:
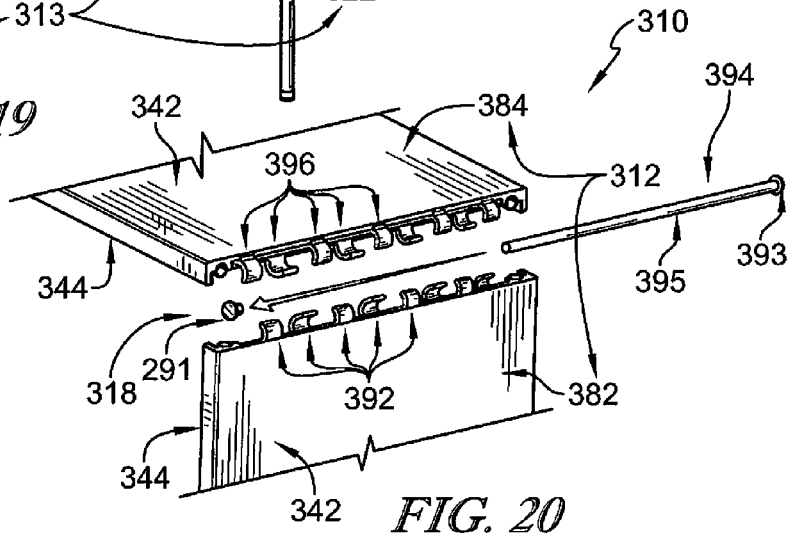
FIG. 20 is a partial exploded perspective view of the folding table of FIG. 19 showing that the hinge unit includes a plurality of fingers extending from the panels of the table top and a hinge pin positioned to extend across the table top between the fingers to allow rotation of the panels relative to one another.
Figure 21:
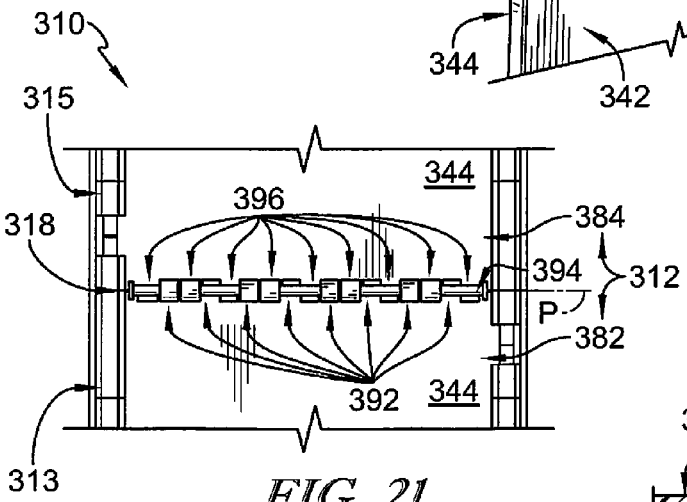
FIG. 21 is a bottom plan view of the folding table of FIG. 19 showing that the fingers are offset and interlaced with one another to allow rotation of the panels of the table top.
Figure 22:
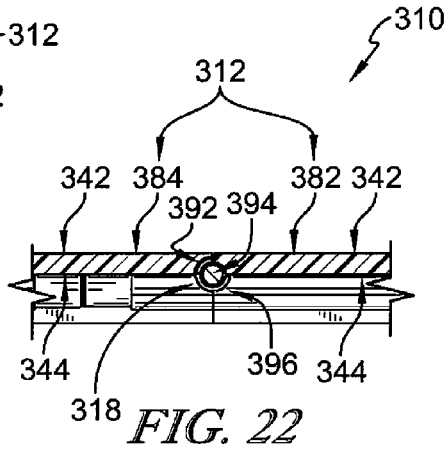
FIG. 22 sectional view taken along line 22-22 in FIG. 19 showing that some of the fingers extend over the hinge pin and some of the fingers extend below the hinge pin to trap the hinge pin between the fingers.

In the illustrative example, hinge unit 318 includes a hinge pin 394 positioned between fingers 392 of right-side panel 382 and fingers 396 of left-side panel 384 as shown in FIGS. 20-22. Hinge pin 394 includes a shaft 395 and a head 393 coupled to shaft 395. Shaft 395 extends between fingers 392, 396 and hinge pin 394 is held in place with a cap 391 that couples to an opposing end of shaft 395 from head 393.

Some fingers 392 extend from top side 342 of right-side panel 382 toward left-side panel 384 and arc downwardly toward under side 344 as shown in FIGS. 20-22. Other fingers 392 extend from under side 344 of right-side panel 382 toward left-side panel 384 and arc upwardly toward top side 342. Fingers 396 are arranged similarly to fingers 392. Fingers 392, 396 may be formed as part of a blow-molding process of right-side and left-side panels 382, 384. Although eight fingers 392 and nine fingers 396 are shown, more or less fingers 392, 396 may be used.

Fingers 392 are offset from fingers 396 such that fingers 392 are positioned between fingers 396 when right-side panel 382 is aligned with left-side panel 384 as shown in FIG. 21. Hinge pin 394 is positioned to extend across table top 312 and between fingers 392, 396 such that shaft 395 of hinge pin 394 is trapped between fingers 392, 396 to couple right-side panel 382 with left-side panel 384. Fingers 392, 396 align along a pivot axis P to allow panels 382, 384 of table top 312 to pivot about hinge pin 394 between an expanded-use position, shown in FIG. 19, and a collapsed-storage position.

In illustrative examples, hinge unit 18 may include opposing cylindrical features molded into the blow molded table top 12. The cylindrical features, when aligned with each other, create a piano type hinge held together with a pin running through holes in the cylinders. Hinge unit 18 creates a strong center across folding table 10.

In illustrative examples, an active leg 22 rotates upward relative to the table top 12 and then slides across the middle of the table top 12 to lock folding table 10 in an open position. A passive leg 24 rotates upward relative to the table top 12 and locks in place with a VALCO pin 78. A swedged tube 56 slides into an opposing tube 58 for continuous support along the table top 12.

In illustrative examples, a pin 268 coming off of a tube 223 engages with a track 264 in a bracket 266 to guide the active leg 222 into position.

In illustrative examples, a hinge 318 may be formed without additional processing of panels 382, 384 of a table top 312.

A method of using a folding table in accordance with the present disclosure includes several steps. The method begins with a pivoting step in which a first panel of a table top pivots relative to a second panel of the table top such that the first and second panels are substantially aligned in the same plane. The method proceeds to a moving step in which the table-locker legs of a table top elevator are moved from an unlocked position extending along one of the first and second panels to a locked position extending away from one of the first and second panels. The method then proceeds to another moving step in which support legs of the table top elevator are moved from a stowed position extending along one of the first and second panels to a support position extending away from one of the first and second panels such that the support legs cooperate with the table-locker legs to support the table top above a ground level.

The first moving step includes a pivoting step in which a leg section of each table-locker leg pivots about a locker-leg pivot axis P2 in a direction D6 relative to the table top as shown in FIGS. 4 and 5. The first moving step further includes a sliding step in which a lock section of each table-locker leg slides along locker-leg pivot axis P2 in a direction D7 relative to the table top such that the lock section extends under both the first and second panel of the table top to engage with an opposing one of the support legs to block rotation of the first and second panels relative to one another.

The second moving step includes a pivoting step in which a leg section of each support leg pivots about a support-leg pivot axis P3 in a direction D8 relative to the table top. The second moving step further includes a sliding step in which a pivot section of each support leg slides along support-leg pivot axis P3 in a direction D9 relative to the table top.

The method further includes an engaging step. During the engaging step, a lock pin coupled to the support leg engages with a pin hole coupled to the table top to block pivoting movement of the support leg relative to the table top when the support leg is in the support position.

The method further includes a disengaging step. During the disengaging step, the lock pin disengages from the pin hole in response to application of a force F2 to allow pivoting movement of the support leg about support-leg pivot axis P3 in a direction D4 relative to the table top and the support leg moves from the support position to the stowed position.

In another example, during the disengaging step the lock pin disengages from the pin hole in response to application of force F2 to allow sliding movement of the support leg along support leg pivot axis P3 away from the hinge unit in direction D5 followed by pivoting movement of the support leg about support-leg pivot axis P3 in a direction D4 relative to the table top. As a result, the support leg moves from the support position to the stowed position.

The method further includes another engaging step. During the engaging step, a position-locator pin coupled to the table-locker leg engages with a pin hole coupled to the table top to block sliding movement of the table-locker leg relative to the table top when the table-locker leg is in the locked position.

The method further includes another disengaging step. During the subsequent disengaging step, the position-locator pin disengages from the pin hole to allow sliding movement of the table-locker leg in response to application of a force F1. The table-locker leg also moves from the locked position to the unlocked position to allow the first and second panels of the table top to pivot relative to one another about axis P in a direction D1. The first or second panel pivot relative to the other one of the first and second panel such that under sides of the first and second panels are in confronting relation.

The moving the table-locker legs step includes a sliding step. During the sliding step, the lock section of each table-locker leg slides along locker-leg axis P2 in a direction D2 away from the hinge unit relative to the table top such that the lock section extends under one of the first and second panel of the table top to allow rotation of the first and second panel relative to one another. The moving the table-locker legs further includes a pivoting step. During the pivoting step, the leg section of each table-locker leg pivots about the locker-leg pivot axis P2 relative to the table top in a direction D3 to a position extending along one of the first and second panels.

The invention claimed is:

1. A folding table comprising a table top including a first panel and a second panel, a hinge unit arranged to extend between and interconnect the first panel and the second panel to cause the first panel to pivot about a pivot axis relative to the second panel between an expanded-use position in which the first and second panel are arranged in generally co-planar relation to one another and a collapsed-storage position in which the first and second panels are arranged in confronting relation to one another, and a table top elevator including a support leg coupled to the first panel to move there with and relative thereto from a stowed position in which the support leg is arranged to extend along the table top to a support position in which the support leg is arranged to extend away from the table top and a table-locker leg coupled to the second panel to move there with and relative thereto from an unlocked position in which the table-locker leg is arranged to extend along the table top and located within a perimeter of the second panel to a locked position in which the table-locker leg is arranged to extend away from the table top and extend past the perimeter of the second panel to engage and mate with the support leg to establish lock means for blocking movement of the table top from the expanded-use position to the collapsed-storage position when the table-locker leg is in the locked position so that the table top remains in the expanded-use position.

2. The folding table of claim 1, wherein the support leg pivots about a support-leg pivot axis during movement between the stowed position and the support position and the support-leg pivot axis is generally perpendicular to the pivot axis.

3. The folding table of claim 2, wherein the table-locker leg pivots about a locker-leg pivot axis during movement between the unlocked position and the locked position and the locker-leg pivot axis is generally perpendicular to the pivot axis and generally parallel to the support-leg pivot axis.

4. The folding table of claim 1, further comprising a leg-slider guide coupled to the second panel in a fixed position relative to the second panel and configured to block the table-locker leg from pivoting relative to the table top when the table-locker leg is in locked position and allow the table-locker leg to pivot when in the table-locker leg is in unlocked position.

5. The folding table of claim 4, wherein the leg-slider guide includes a cover plate coupled to the second panel in a fixed position relative to the second panel and a wedge coupled to the table-locker leg to move therewith and configured to travel in a guide track formed in the cover plate.

6. The folding table of claim 5, further comprising a pivot guide coupled to the first panel in a fixed position relative to the first panel and configured to block the support leg from sliding relative to the first panel while allowing support leg to pivot relative to the first panel.

7. The folding table of claim 6, wherein the pivot guide includes a guide plate coupled to the first panel in a fixed position relative to the first panel and a guide pin coupled to the support leg to move therewith and configured to travel in a guide slot formed in the guide plate.

8. The folding table of claim 5, wherein the wedge had a diamond shape including two corners of the wedge are opposite one another and have a rounded shape.

9. The folding table of claim 5, wherein the guide track includes a pivot portion spaced apart from the hinge unit and a slide portion located between the pivot portion and the hinge unit.

10. The folding table of claim 9, wherein the slide portion extends from the pivot portion toward the hinge unit along a straight path.

11. The folding table of claim 10, wherein the pivot portion extends away from the slide portion and the hinge unit along a curved path.

12. The folding table of claim 1, further comprising a pivot guide coupled to the first panel in a fixed position relative to the first panel and configured to block the support leg from sliding relative to the first panel while allowing support leg to pivot relative to the first panel.

13. The folding table of claim 12, wherein the pivot guide includes a guide plate coupled to the first panel in a fixed position relative to the first panel and a guide pin coupled to the support leg to move therewith and configured to travel in a guide slot formed in the guide plate.

14. The folding table of claim 1, wherein an end connector included in the table-locker leg is configured to be received in an end receiver included in the support legs when the table-locker leg are in the locked position.

15. The folding table of claim 1, wherein the hinge unit includes a first hinge-pin receiver coupled to the first panel in a fixed position relative to the first panel, a second hinge-pin receiver coupled to the second panel in a fixed position relative to the first panel, and a hinge pin arranged to extend through and interconnect the first and second hinge-pin receivers to cause the first panel to be coupled to the second panel and allow rotation of the first panel relative to the second panel.

16. The folding table of claim 1, wherein the hinge unit includes a first plurality of fingers coupled to the first panel in a fixed position relative to the first panel, a second plurality of fingers coupled to the second panel in a fixed position relative to the second panel, and a hinge pin arranged to extend through and interconnect the first plurality and second plurality of fingers to cause the first panel to be coupled to the second panel and allow rotation of the first panel relative to the second panel.

17. The folding table of claim 1, wherein the table-locker leg includes a leg section and a lock section coupled to the leg section and the leg section pivots relative to the table top about a locker-leg pivot axis defined by the lock section.

18. The folding table of claim 17, wherein the lock section of the table-locker leg is arranged to extend under the second panel when the table-locker leg is in the unlocked position and extend under both the first panel and the second panel to block rotation of the first and second panel relative to one another when the table-locker leg is in the locked position.

19. The folding table of claim 1, wherein the table-locker leg includes a leg section, a lock section coupled to the leg section and the leg section pivots relative to the table top about a locker-leg pivot axis defined by the lock section, and a position-locating pin coupled to lock section to move therewith and relative thereto.

20. The folding table of claim 19, further comprising a leg-slider guide coupled to the second panel in a fixed position relative to the second panel and configured to block the table-locker leg from pivoting relative to the table top when in the table-locker leg is in locked position and allow the table-locker leg to pivot when in the table-locker leg is in unlocked position, the leg-slider guide includes a cover plate coupled to the second panel in a fixed position relative to the second panel and a wedge coupled to the lock section of the table-locker leg to move therewith and configured to travel in a guide track formed in the cover plate.

21. The folding table of claim 20, wherein the position-locator pin is biased to extend into a pin hole formed in the cover plate when the table-locker leg is in the locked position.

* * * * *